United States Patent [19]

Carr

[11] Patent Number: 5,003,748

[45] Date of Patent: Apr. 2, 1991

[54] METAL FRAME STRUCTURE

[75] Inventor: Noel R. Carr, Brisbane, Australia

[73] Assignee: Supertruss Pty. Ltd., Ashmore, Australia

[21] Appl. No.: 457,750

[22] PCT Filed: Jun. 20, 1988

[86] PCT No.: PCT/AU88/00196

§ 371 Date: Jan. 10, 1990

§ 102(e) Date: Jan. 10, 1990

[87] PCT Pub. No.: WO88/10343

PCT Pub. Date: Dec. 29, 1988

[30] Foreign Application Priority Data

Jun. 19, 1987 [AU] Australia ..... PI2569

[51] Int. Cl.[5] ..... E04C 3/02; E04C 3/30

[52] U.S. Cl. ..... 52/693; 52/695; 403/217; 403/219

[58] Field of Search ..... 52/693, 694, 695, 650, 52/655; 403/217, 219

[56] References Cited

U.S. PATENT DOCUMENTS

| | | | |
|---|---|---|---|
| 2,146,540 | 2/1939 | Hahn et al. . | |
| 3,122,224 | 2/1964 | Blickensderfer | 52/694 |
| 3,656,267 | 4/1972 | Engle . | |
| 4,030,264 | 6/1977 | Jackson | 52/693 |

FOREIGN PATENT DOCUMENTS

| | | | |
|---|---|---|---|
| 571088 | 9/1958 | Belgium | 52/693 |
| 1131872 | 9/1982 | Canada . | |
| 2925599 | 6/1976 | Fed. Rep. of Germany . | |
| 7804517 | 2/1978 | France . | |
| 400158 | 3/1985 | PCT Int'l Appl. . | |
| 584317 | 1/1977 | Switzerland . | |
| 493635 | 10/1938 | United Kingdom | 52/693 |

OTHER PUBLICATIONS

International Search Report.

*Primary Examiner*—Neill R. Wilson

*Attorney, Agent, or Firm*—Michael B. Lasky

[57] ABSTRACT

A metal frame structure of the type employing two chords (11) extending in generally the same longitudinal direction and having a plurality of webs (12) extending in zig-zag configuration between the chords (11). The webs (12) are secured to the chords (11) at a plurality of frame joints (13). At each frame joint adjacent webs have opposed flattened end portions (22) which extend in overlapping relation along the inner sides of a respective chord (11) and are secured to the chord by transversely spaced fasteners (14).

7 Claims, 3 Drawing Sheets

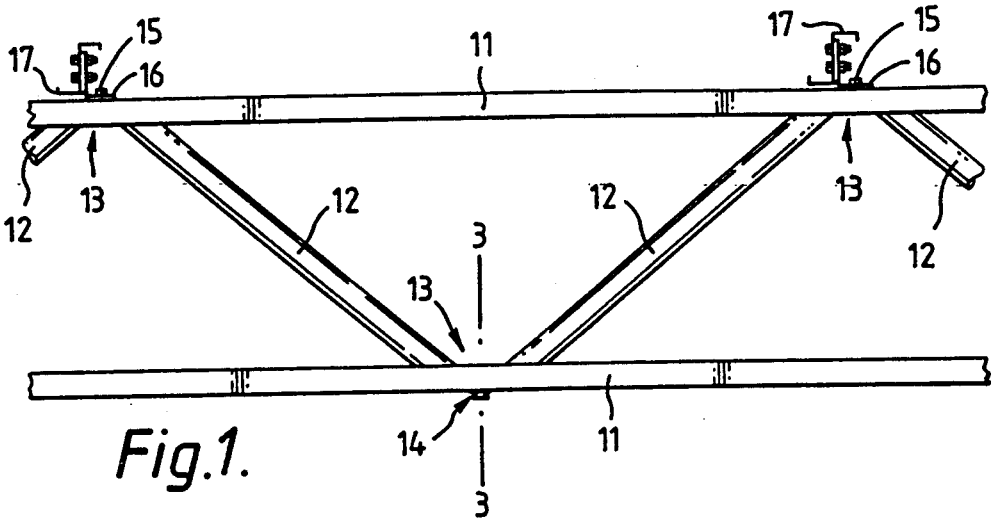
Fig.1.
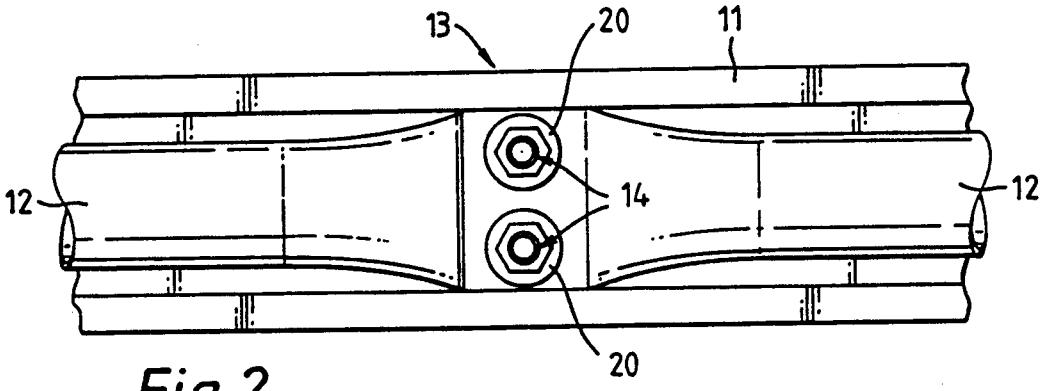
Fig.2.
Fig.3.
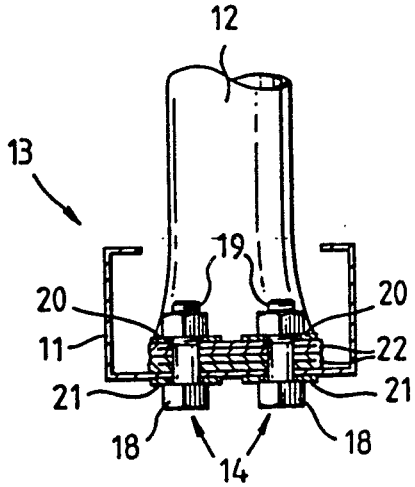

METAL FRAME STRUCTURE

TECHNICAL FIELD

THIS INVENTION relates to an improved metal frame structure of the type employing two or more chords extending in generally the same longitudinal direction and in spaced relation and having diagonal webs connected to the chords by fasteners. More particularly the invention relates to a novel frame joint which the webs can be connected to the chords. The present invention has particular but not limiting application to truss frames, planar and space frames, columns, beams, rafters, poles, towers, and conveyor galleries.

BACKGROUND ART

Frame structure are known which employ webs made from tubular metal having opposed flattened end portions. Fasteners such as bolts or screws are employed at the frame joint to secure the flattened end portions to the chords.

Known frame joints vary in complexity and strength. In Australian patent No. 295,018 a frame structure is described having two chords which extend generally in the same longitudinal direction and a plurality of webs extend in zig-zag configuration in the space between the chords. Each web has opposed flattened end portions which extend along respective inner sides of the respective chords so that adjacent flattened end portions of adjacent webs extend in overlapping relation. A single bolt extends through the overlapping end portions and through the inner side of the chord to form the frame joint by which the adjacent webs are secured to the chords. All the frame joints employed in the frame structure of AU 295,018 are of this type. As a consequence the frame structure can be manufactured from a plurality of identical webs.

A major disadvantage of this frame joint is that it is inherently weak and as a consequence the whole frame structure has a tendency to twist under load. In addition it is often desirable to fix brackets to the frame structure at the frame joint and the frame joint of AU 295,018 does not readily facilitate rigid fixing of a bracket.

In U.S. Pat. No. 3,925,951 a similar frame structure is described. However, in this frame structure two fasteners are employed at each frame joint. The frame structure of U.S. Pat. No. 3,925,951 includes two wooden chords which extend generally in the same longitudinal direction and a plurality of tubular metal webs extend in zig-zag configuration in the space between the chords. Two different webs are employed and alternate along the structure. One web is referred to as a tension web and has opposed flattened end portions. The opposed flattened end portions of the tension web each have two holes, spaced longitudinally relative to the chords, through which the tension web is secured to the chords by fasteners. The other web is referred to as a compression web and has opposed flattened end portions which are arranged in overlapping relation with the flattened end portions of the tension webs. The flattened end portions of the compression webs have a single hole and are secured in overlapping relation with the tension web by a common fastener. Thus each frame joint employs two fasteners only one of which is common to both the compression and tension webs.

While the frame joint of U.S. Pat. No. 3,925,951 is stronger than the frame joint of AU 295,018 the longitudinal spacing of the fasteners provides little transverse strength to resist twisting. In U.S. Pat. No. 3,925,951 two different webs are required which results in increased manufacturing costs.

A further problem arises when adapting the structure of U.S. Pat. No. 3,925,951 to a completely metal frame structure where the chord holes are to be predrilled or prepunched. The fastening holes are in pairs with each hole in the pair closely spaced in the longitudinal direction. Thus the tolerance required in scheduling the holes is much higher than in the case of longitudinally widely spaced holes. This results in the need for higher quality control and associated with higher quality control one can expect higher costs.

DISCLOSURE OF THE INVENTION

It is a principal object of the present invention to overcome or at least alleviate the problems associated with the prior art.

In one broad aspect therefore the present invention resides in a frame structure including two chords and a plurality of webs secured to the chords by fasteners at a plurality of frame joint, said chords extending in generally the same longitudinal direction and in spaced relation, said plurality of webs extending in zig-zag configuration between the chords, each said web having opposite end portions which are flat, the respective end portions of each said web extending in opposite longitudinal directions along respective inner sides of the chords, adjacent said end portions of adjacent said webs extending in overlapping relation and said fasteners at each said frame joint being transversely spaced relative to the longitudinal direction and extending through said overlapping end portions and through said inner sides of said chord.

The chords can be of any cross-sectional shape but preferably include flat portions which co-operate with the flat end portions of the respective webs. Advantageously the chords are either tubular or of channel section. Where the chords are tubular they can include longitudinally extending flattened portions at each frame joint. The flattened portions of any one chord can be oriented in the same plane or in different planes. For example, in the case where the frame structure is a tower or beam of generally equilateral prismatic shape the chords would define the apical edges of the prism and the webs would define the sides. The flattened portions of each chord would be oriented alternately along each chords between two longitudinal planes 60° apart. Thus, the web at each alternate joint would be connected at their other ends to respective alternate chords.

The chords preferably include predrilled or prepunched holes for receiving the fasteners. The chords can be parallel or they can converge.

The webs can be of any cross-sectional shape but are preferably tubular. The webs preferably include predrilled or prepunched holes for receiving the fasteners.

The fasteners can be of any known types such as rivets or bolts. Preferably however, bolts are employed. The fasteners can be longitudinally spaced by a distance less than their transverse spacing. Preferably, however, the fasteners are not longitudinally spaced. It is preferable that two fasteners be employed however, more than two fasteners can be used to form a frame joint. For example longitudinally spaced pairs of fasteners may be used. The fasteners may serve a dual purpose by securing framework to the out side of the chords. For example, webs, brackets or additional chords may be secured to the outside of the chords by the fasteners. The frame structure can include additional chords and webs secured together at additional frame joints. The chords of the frame structure can be located in the same plane to form a planar frame structure or in different planes to form a three dimensional frame structure. In these embodiments the frame structure can include fasteners which secure web end portions to opposite sides of a chord.

BRIEF DESCRIPTION OF THE DRAWINGS

In order that the invention may be more readily understood and be put into the practical effect reference will now be made to the accompanying drawings and wherein:

FIG. 1 is a side view illustrating an application of the present invention to a truss.

FIG. 2 is a plan view of frame joint for use in a frame structure according to the invention.

FIG. 3 is a cross-sectional view through 3—3 of the frame joint of FIG. 2.

BEST MODE FOR CARRYING OUT THE INVENTION

Figure 4:
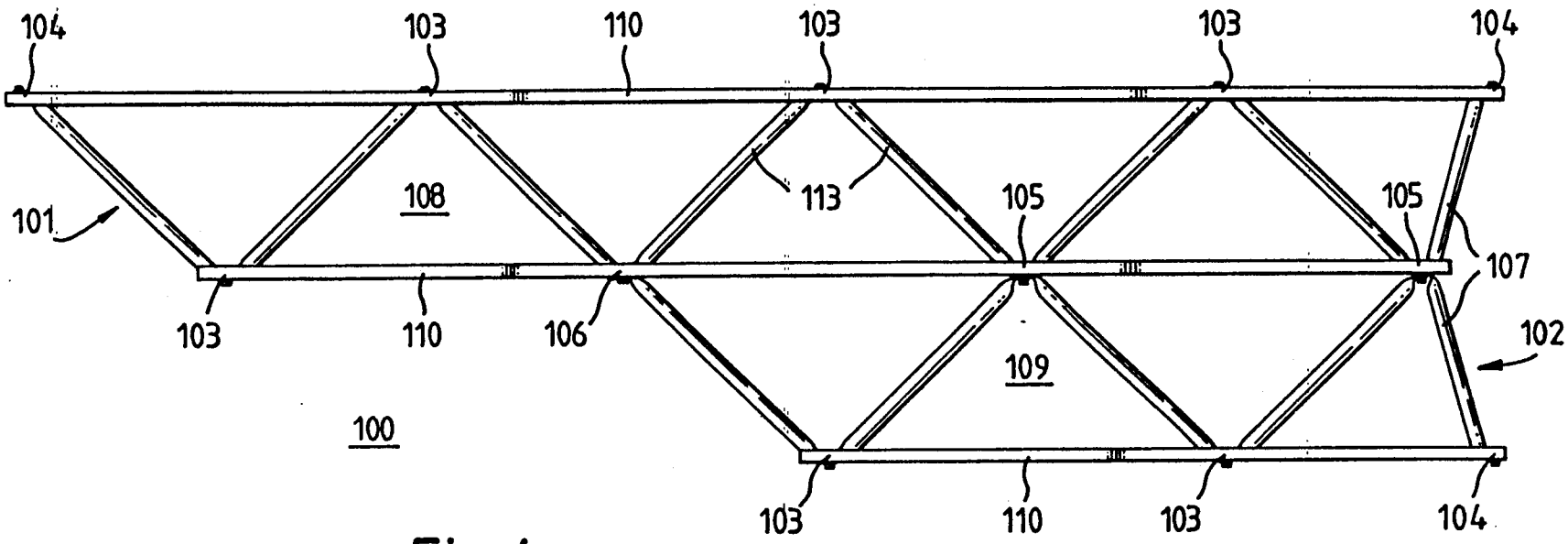
FIG. 4 is a further frame structure according to the present invention.

Referring to FIG. 1, there is illustrated a frame structure which in this case is a truss 10. The truss 10 has two parallel spaced chords 11. A plurality of webs 12 extend in zig-zag configuration in the space between the chords and are secured to the chords at frame joints 13 by pairs of fasteners 14 and 15 (more clearly seen in FIGS. 2 and 3).

Fasteners 15 serve a dual purpose in the illustrated embodiment. As can be seen brackets 16 are rigidly secured to the truss 10 by the fasteners 15 which also serve to secure the webs 12 to the chords 11. A roofing purlin 17 is illustrated secured to brackets 16 and extends transversely of the truss 10.

Referring to FIGS. 2 and 3, one exemplary frame joint 13 is illustrated in more detail. The chord 11 is of channel section and the fasteners 14 comprise bolts 18, nuts 19 and washers 20 and 21. The webs 12 have overlapping flattened end portions 22 which have been predrilled or prepunched to accommodate the bolts 18. The channel could be replaced by a tube having a flattened portion at the frame joint.

Referring to FIG. 4, there is illustrated a further frame structure according to the present invention in the form of a cantilever truss 100 having multiple layers 101 and 102 in this case two layers are shown although more layers may be employed.

Frame joints 103 are similar to the frame joints illustrated in respect of FIGS. 2 and 3. Frame joints 104 are end joints, joints 105 are four way joints which will be illustrated below and joint 106 is a three way joint.

As can be seen the webs 107 are angled to the horizontal at a different angle than the other webs.

The frame structure illustrated in FIG. 4 is made up of a single layer section 108 and a double layer section 109 and it is envisaged that many variations in layering will be applicable to the present invention. Indeed frame structures within frame structures in nested fashion are also applicable to the present invention. It will be appreciated that each web of FIG. 4 is secured at the respective frame joints by two transversely spaced bolts as in FIGS. 2 and 3 frame joint. However, it will be realised that in some structures some joints may include more or less fasteners.

Figure 5:
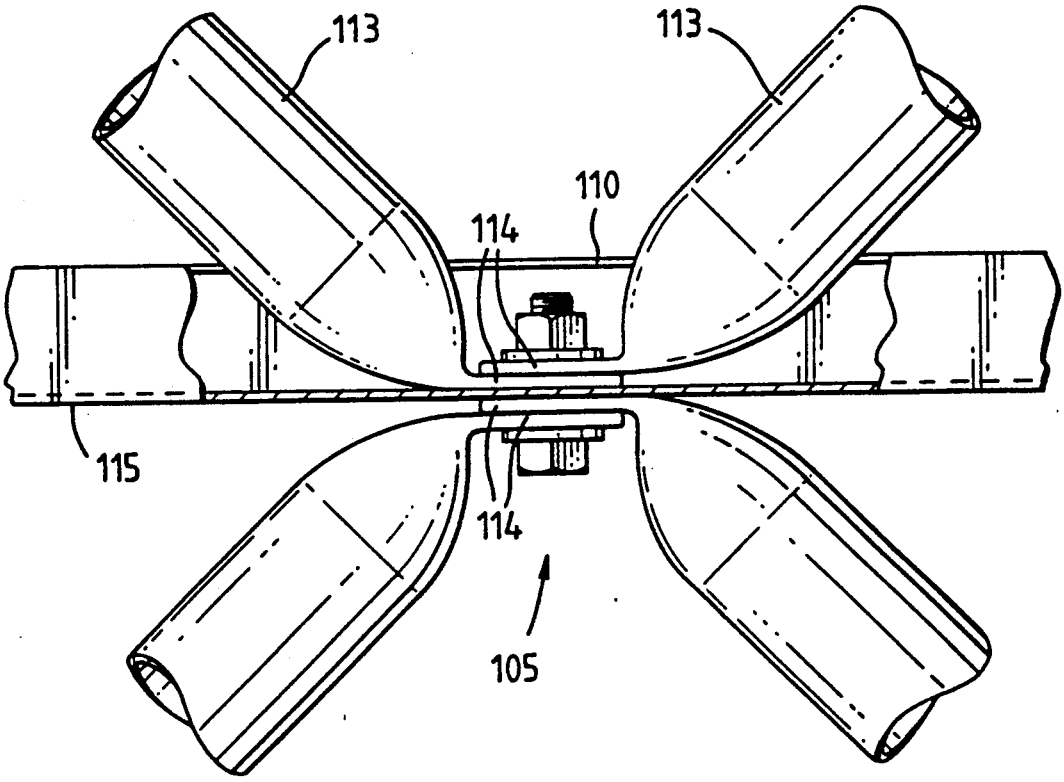
FIG. 5 is another frame joint incorporating features of the present invention.

Referring to FIG. 5, there is illustrated a frame joint 105 of FIG. 4 where the near side of the channel 110 has been cutaway to illustrate the frame joint. In this case two transversely spaced bolts are used which in effect secure in back to back relationship two frame joints of the type illustrated in FIGS. 2 and 3. The webs 113 have overlapping flats 114 which are secured to either side of the pan 115 of the channel 110. The channel could be replaced by a tube having a flattened portion at the joint.

It will be realised that in all embodiments the channel chords may be reversed or replaced by other suitable chords of alternative cross-section which could be suitably secured to the flats of the webs.

Whilst the above has been given by way of illustrative example of the invention, it will of course be realised that many modifications and variations may be made to the above described embodiment by persons skilled in the art without departing from the broad scope and ambit of the invention as set forth in the attached claims.

I claim:

1. A frame joint for a truss including a pair of substantially parallel or spaced unitary chords and a plurality of elongated tubular webs secured to each chord by fasteners wherein said frame joint includes a junction of two webs and a respective chord wherein said webs include flattened end portions which overlap each other and an adjacent chord section so as to define at least three relatively narrow structural parts in transverse cross-section which are interconnected by a single pair of fasteners transversely aligned to a longitudinal axis of the adjacent chord.

2. A frame joint as claimed in claim 1, wherein said chords are of channel section.

3. The frame joint as claimed in claim 1, wherein said chord is of a U-shaped section defining a pair of opposite side walls connected by a web and where said fasteners pass through said web.

4. A frame structure including a pair of substantially parallel or spaced unitary chords and a plurality of elongate tubular webs secured to each chord, said plurality of webs extending in generally zig-zag configuration between the chords, each said web having flattened end portions and forming a frame joint with an adjacent chord so as to define at least three relatively narrow structural parts in transverse cross-section having regard to the longitudinal axis of the adjacent chord wherein said structural parts are interconnected by a single pair of fasteners transversely aligned to each said longitudinal axis, each said frame joint thereby occurring at spaced intervals along each unitary chord.

5. The frame structure as claimed in claim 4, wherein said unitary chords are of channel section.

6. The frame structure as claimed in claim 4, including additional chords or webs, said additional chords or webs being located in the same plane to form a planar frame structure or in different planes to form a three dimensional frame structure.

7. A frame structure as claimed in claim 4, wherein further framework is secured by said fasteners.

* * * * *